US011352861B2

(12) United States Patent
Anderson et al.

(10) Patent No.: US 11,352,861 B2
(45) Date of Patent: Jun. 7, 2022

(54) PERFORATING APPARATUS

(71) Applicant: Weatherford U.K. Limited, Leicestershire (GB)

(72) Inventors: Neil Anderson, Aberdeen (GB); Michael Ronson, Aberdeen (GB)

(73) Assignee: Weatherford U.K. Limited, Leicestershire (GB)

( * ) Notice: Subject to any disclaimer, the term of this patent is extended or adjusted under 35 U.S.C. 154(b) by 135 days.

(21) Appl. No.: 16/843,320

(22) Filed: Apr. 8, 2020

(65) Prior Publication Data

US 2020/0362675 A1 Nov. 19, 2020

(30) Foreign Application Priority Data

May 14, 2019 (GB) ..... 1906801

(51) Int. Cl.
*E21B 43/1185* (2006.01)
*E21B 34/14* (2006.01)

(52) U.S. Cl.
CPC ..... *E21B 43/11852* (2013.01); *E21B 34/142* (2020.05)

(58) Field of Classification Search
CPC ..... E21B 23/04; E21B 23/0413; E21B 34/14; E21B 34/142; E21B 43/116; E21B 43/117; E21B 43/1185; E21B 43/11852
See application file for complete search history.

(56) References Cited

U.S. PATENT DOCUMENTS 3,913,671 A * 10/1975 Redford ..... E21B 43/24 166/272.4
4,836,109 A 6/1989 Wesson et al.
(Continued)

FOREIGN PATENT DOCUMENTS

GB 2591027 A * 7/2021 ..... E21B 17/02
WO 2011008592 A2 1/2011
(Continued)

OTHER PUBLICATIONS

Extended European Search report dated Sep. 17, 2020 in EP Patent Application No. 20168544.3.
(Continued)

*Primary Examiner* — Jennifer H Gay
(74) *Attorney, Agent, or Firm* — Blank Rome LLP

(57) ABSTRACT

An apparatus comprises perforating guns, bypass, and isolator mechanism. The first gun fires upon receipt of a first pressure signal delivered from a first axial side of the first gun. The second perforating gun is mounted on a second axial side of the first perforating gun, and fires upon receipt of a second pressure signal delivered from the first axial side of the first perforating gun. The bypass extends from the first axial side of the first gun to the second gun for communicating the second pressure signal to the second gun. The isolator mechanism is configurable between a first configuration in which the bypass is isolated from receiving a pressure signal to the second perforating gun, and a second configuration in which the bypass is permitted to receive a pressure signal. The isolator mechanism is reconfigurable from the first to the second configuration after the first gun has fired.

19 Claims, 9 Drawing Sheets

(56) References Cited

U.S. PATENT DOCUMENTS 5,287,924 A * 2/1994 Burleson ..... E21B 43/11852 166/297
5,355,957 A * 10/1994 Burleson ..... E21B 43/11852 166/297
5,551,520 A 9/1996 Bethel et al.
5,598,894 A * 2/1997 Burleson ..... E21B 43/11852 166/297
5,890,539 A * 4/1999 Huber ..... E21B 43/11852 166/297
9,470,071 B2 10/2016 Morrison et al.
2007/0187103 A1* 8/2007 Crichlow ..... E21B 43/2406 166/302
2007/0199707 A1* 8/2007 Hocking ..... E21B 43/24 166/280.1
2009/0145606 A1* 6/2009 Hocking ..... E21B 43/26 166/303
2010/0243272 A1* 9/2010 Coronado ..... E21B 17/1035 166/380
2011/0011643 A1* 1/2011 Phillips ..... E21B 43/11852 175/4.52
2014/0014373 A1* 1/2014 Richards ..... E21B 17/026 166/385
2017/0175497 A1* 6/2017 Harive ..... E21B 43/11852
2017/0204680 A1* 7/2017 Leismer ..... H01R 13/005
2020/0362675 A1* 11/2020 Anderson ..... E21B 43/11852

FOREIGN PATENT DOCUMENTS

WO 2015171279 A1 11/2015
WO WO-2017009440 A1 * 1/2017 ..... E21B 17/026

OTHER PUBLICATIONS

Combined search and examination report dated Nov. 5, 2020 in GB Patent Application No. GB1906801.4.

* cited by examiner

PERFORATING APPARATUS

FIELD

The present disclosure relates to a perforating apparatus and method for use in perforating a structure, for example, in a wellbore.

BACKGROUND

Perforating apparatuses are used to create holes or perforations in structures by the firing of explosive charges. In the oil and gas industry, for example, perforating apparatuses are commonly used for a variety of applications, ranging from production to decommissioning. In recent years, however, as more wells are reaching the end of their lifecycle, there is an increasing requirement to improve technology concerned with the decommissioning of wells.

Perforating apparatuses are known, and typically include a single perforating gun or an assembly of axially arranged perforating guns. In the latter case, it is common that the perforating apparatus will be configured to fire the lower gun first, which may provide for a simpler design, but may be problematic for some applications. For example, if the perforating apparatus is required to create two or more sets of perforations in a well structure near a well-control system, there is potential that the upper gun may be aligned with the well-control system when firing the lower gun. An unintentional misfire of the upper gun may thus pose a serious risk to the well-control system. Therefore, it is common practice to individually run two separate perforating guns into the wellbore to avoid this risk. However, this increases the time and cost to complete the application.

SUMMARY

An aspect of the present disclosure relates to a perforating apparatus, comprising:

- a first perforating gun configured to fire upon receipt of a first pressure signal delivered from a first axial side of the first perforating gun;
- a second perforating gun mounted on a second axial side of the first perforating gun and configured to fire upon receipt of a second pressure signal delivered from the first axial side of the first perforating gun;
- a bypass extending from the first axial side of the first perforating gun to the second perforating gun for communicating the second pressure signal to the second perforating gun; and
- an isolator mechanism configurable between a first configuration in which the bypass is isolated from receiving a pressure signal for the second perforating gun, and a second configuration in which the bypass is permitted to receive a pressure signal;
- wherein the isolator mechanism is reconfigurable from the first configuration to the second configuration after the first perforating gun has been fired.

In use, the first perforating gun may receive the first pressure signal when the isolator mechanism is in the first configuration. The bypass and second perforating gun may be isolated from receiving a pressure signal, for example the first pressure signal, when the isolator mechanism is in the first configuration and therefore the risk of the second perforating gun unintentionally firing may be minimized. Once the first perforating gun has been fired, the isolator mechanism may be reconfigured to the second configuration, thus permitting the second pressure signal to enter the bypass and fire the second perforating gun. The apparatus may therefore provide for reliable, independent and sequential firing of first and second perforating guns, with the capability of firing the first perforating gun (e.g. an uphole perforating gun) first. This may be beneficial for various applications, as is discussed below.

For example, one application of the perforating apparatus may relate to a wellbore application. In this instance, the perforating apparatus may be run into the wellbore by a tubing string. The first and second pressure signals may comprise hydraulic pressure signals. Such signals may be communicated to the perforating apparatus from a pump and/or via the tubing string. The pump, for example, may be located at surface. Alternatively, the perforating apparatus may be provided with an on-board pump.

Furthermore, in use, the perforating apparatus may be mounted to the tubing string on the first axial side of the first perforating gun. In this respect, the first perforating gun may be defined as an upper or uphole gun and the second perforating gun may be defined as a lower or downhole gun. The perforating apparatus may thus provide for firing of the upper gun before the lower gun. This may be particularly beneficial for various applications. For example, one such application may involve perforating a wellbore structure at a location within the wellbore close to the wellhead area. The wellhead area may comprise a well-control system which may, for example, comprise a blow-out preventer (BOP). As the perforating apparatus is configured to fire the upper gun first, this may enable the lower gun to be positioned further into the wellbore and away from the well-control system during firing of the upper gun. Thus, in the event of an unintentional misfire of the lower gun, for example, when attempting to fire the upper gun, the lower gun may not be axially aligned with the well-control system, as might be the case for the upper gun if the lower gun had to be fired first. Furthermore, the isolator mechanism may reduce the likelihood of accidental misfire of the second perforating gun. Therefore, in this example application, the perforating apparatus may reduce the risk of damage to the well-control system.

The above-described application may be particularly useful for a well-decommissioning operation. For example, government regulations concerning well decommissioning may require certain operations to be performed prior to the final abandonment of a well. One such operation may involve the recovery of an oil-based mud trapped in an annulus of a wellbore structure. The recovery may be achieved by injecting and circulating a pressurized fluid through the annulus to remove the trapped mud. Thus, it may be necessary to perforate the wellbore structure at two axially spaced locations to enable pressurized fluid to be circulated through the annulus. In an example, the trapped oil-based mud may be located towards the wellhead area and thus perforation of the structure may pose a risk to damage of the well-control system, as discussed above. In this example application, the perforating apparatus may provide for safe and efficient recovery of trapped oil-based mud from an annulus in a wellbore.

The perforating apparatus may comprise a third perforating gun. The second perforating gun may be provided between the first and third perforating guns. The third perforating gun may be mounted on an axial side of the second perforating gun that is on an opposite side of the second perforating gun to the first perforating gun. Thus, in this example, the first gun may be defined as an upper or uphole gun, the second gun as an intermediate gun and the third gun as a lower or downhole gun. One example application of such an apparatus may involve firing of the first and second guns as detailed above, e.g. to complete an oil-based mud recovery operation, and subsequently firing the third gun at a position further into the wellbore. This may be particularly useful when it is required to pressure test a naturally-formed seal, for example, formed against an external surface of the wellbore. A naturally-formed seal may be formed by the creep of a rock formation towards the wellbore. For example, the rock formation may comprise sedimentary rock, such as shale rock. In this example application, the third gun may perforate the wellbore at a position below the naturally-formed seal, such that a pressure signal may be communicated through the perforations to test the sealing capability of the seal. If the results are positive, this may reduce the need to provide additional artificial seals within the wellbore.

One or more or each of the first, second and/or third perforating guns may comprise one or more charges. The charges may be located in scallops in an outer surface of the respective perforating gun. The one or more charges of at least the first, and optionally the second, perforating guns may be configured to fire with a trajectory or sequence in accordance with a charge or shot profile defined by the respective perforating gun. The charge or shot profile may comprise a helix, e.g. the charge or shot profile may comprise a helical arrangement of the charges. The charge or shot profile may comprise a maximum number of eighteen charges or shots per foot. Alternatively, the charge or shot profile may comprise a maximum number of twelve charges or shots per foot, or eight charges or shots per foot. The charge or shot profile may be arranged to define a non-firing zone. The non-firing zone may be an area in which no charges are fired.

The bypass may extend from the first axial side of the first perforating gun to the second perforating gun externally of the first perforating gun. The bypass may extend through the non-firing zone. In this way, the bypass may traverse the first perforating gun to the second perforating gun without being damaged, in use, by firing of the charges of the first perforating gun. Despite being in close proximity to the charges of the first perforating gun, the bypass may be configured to withstand pressures up to a maximum pressure in the range of 750 to 1750 bar, e.g. in the range from 1000 to 1500 bar, such as 1,337 bar.

The bypass may extend linearly through the non-firing zone, which may provide a direct channel for the second pressure signal to be delivered to the second perforating gun, and/or may be less likely to clog. Alternatively, the bypass may helically extend around the first perforating gun. The bypass may be configured to follow the charge or shot profile but may be displaced from the charge or shot profile such that it is in an area in which no charges are fired. For example, both the charge or shot profile and the bypass may define corresponding helices that are displaced from each other. In examples, the bypass may have a diameter between 6 and 26 millimeters or 5 and 15 millimeters. The bypass may comprise a conduit, for example pipe or tubing.

The bypass may be supported by a clamp connected to the first perforating gun. The clamp may comprise an aperture for locating the bypass therein. The clamp may be connected to the first perforating gun via a lock key. The bypass may be attached to a series of clamps. One or more of the series of clamps may be axially spaced along the first perforating gun. The one or more clamps may act to prevent the bypass from excessive deflection and/or vibration during firing of the first perforating gun, thereby providing structural support to the bypass. The one or more clamps may comprise a plurality of circumferentially spaced apertures for locating one or more bypasses therein.

In the first configuration, the isolator mechanism may isolate the bypass from receiving the second pressure signal for the second perforating gun. The bypass may be connected to a port in the isolator mechanism, which may be located on a side face thereof. The isolator mechanism may be located on the first axial side of the first perforating gun. The port may be configured to connect with an end of the bypass that extends from the first axial side of the first perforating gun. In an example, the port and bypass may be threadably connected. Alternatively, the port and bypass may be connected via an interference fit and/or with a fastener and/or the like.

The isolator mechanism may comprise a moveable object, which may be movable in order to reconfigure the isolator mechanism between the first and second configurations. In the first configuration of the isolator mechanism, the moveable object may block a pressure signal from entering the port and/or bypass. In the second configuration, the moveable object may allow a pressure signal to enter the bypass to the second perforating gun, e.g. by the movable object being removed from the port.

The isolator mechanism may comprise a body defining a passageway. The passageway may be configured to permit a pressure signal to pass therethrough and may be configured to enable the moveable object to move therein relative to the body. The moveable object may be or comprise a sleeve. The sleeve may be slideable within the passageway of the body. The sleeve may be configured to slide from a first location when the isolator mechanism is in the first configuration to a second position when the isolator mechanism is in the second configuration. In this respect, the sleeve may be defined as a slideable sleeve. In alternative examples, however, the moveable object may comprise a gate, or any other suitable means.

As noted above, in the first configuration of the isolator mechanism, the bypass may be isolated from receiving a pressure signal (e.g. the second pressure signal) for the second perforating gun. The isolator mechanism may comprise a releasable connection configured to releasably secure the isolator mechanism in the first configuration. The releasable connection may prevent the isolator mechanism from unintentionally transitioning from the first configuration to the second configuration. For example, this may be particularly beneficial when a pressure signal is initially circulated through the apparatus and a force acts on the isolator mechanism. The releasable connection may function to selectively prevent the isolator mechanism from transitioning to the second configuration. This arrangement may prevent, or reduce the likelihood of, unintended firing of the second perforation gun, particularly when firing the first perforation gun.

The releasable connection may, for example, comprise a locking member such as a locking ring. The locking member may be fixed or coupled to the moveable object and, when the isolator mechanism is in the first configuration, the locking member may be releasably engaged with or secured to a first recess or other lock structure of the isolator mechanism. The locking member may be radially outwardly biased such that the locking member is forced into contact with the first recess or other lock structure. The first recess or other lock structure may comprise an oblique surface. The locking member may be configured to engage with the oblique surface, e.g. to releasably secure the isolator mechanism in the first configuration.

The locking member may be configured to be released from the first recess or other lock structure when acted on by a predetermined force or differential pressure, which may thereby allow the isolator mechanism to transition to the second configuration. This may be achieved, for example, by selecting a material of the locking member that is configured to sufficiently deform at the predetermined force such that the locking member is able to slide across the oblique surface of the first recess and release the releasable connection. Such an arrangement may provide a level of control over reconfiguring of the isolator mechanism from the first configuration to the second configuration. In alternative examples, the releasable connection (e.g. the locking member) may comprise a shear pin, spring, adhesive, or any other suitable means.

In the second configuration of the isolator mechanism, in which the bypass is permitted to receive a pressure signal to the second perforating gun, the locking member (e.g. the locking ring) may be configured to engage a second recess or other lock structure in the isolator mechanism. The second recess or other lock structure may be positioned axially away from the first recess or other lock structure in a direction towards the first perforating gun. The second recess or other lock structure may comprise a substantively right-angled surface, or shoulder, which may be configured to engage the locking member. Once engaged, the locking member may be fixedly secured to the second recess or other lock structure. In this respect, the locking member and the second recess or other lock structure together may be defined as a locking mechanism. In alternative examples, the locking mechanism may comprise a swellable material, ratchet, adhesive, or any other suitable means.

The locking mechanism may prevent the isolator mechanism from unintentionally transitioning from the second configuration back to the first configuration. As such, the isolator mechanism may be reconfigurable only from the first configuration to the second configuration.

The perforating apparatus may comprise a flow diverter. The flow diverter may be mounted on the first axial side of the first perforating gun, and may be configured to divert a flow away from the first perforating gun. The flow diverter may comprise a diversion path configured to divert flow away from the first perforating gun. The diversion path may be arranged so as to direct flow within the tubing string out of the tubing string, e.g. into the wellbore. The flow diverter may comprise at least one activation path configured to deliver a pressure signal (e.g. the first pressure signal) to the first perforating gun.

The flow diverter may enable a pressure signal or other flow to be initially circulated through the perforating apparatus without the first or second perforating gun being fired. Thus, it may be possible to maintain a constant pressure signal or other flow through the perforating apparatus before, during and after firing of the first and second perforating guns. Such an arrangement may provide for a simplified operation of the perforating apparatus, as, for example, a pump supplying pressure to the apparatus may be maintained at a constant flow rate, operating condition or pressure throughout the entire operation.

The isolator mechanism and the flow diverter may be connected, for example, via a threaded connection, an interference fit, a fastener or other suitable connection.

The diversion path may comprise at least one diversion inlet, which may be placed centrally within the flow diverter. The diversion path may comprise a tapered section, e.g. at the diversion inlet. The tapered section may be inwardly tapered as it extends in a direction generally away from the diversion inlet and towards a diversion outlet. The diversion outlet may comprise an outlet port, which may be located on an external, side face of the flow diverter. The diversion outlet may comprise a plurality of, e.g. three, circumferentially spaced outlet ports. The outlet ports may all be located on the external, side face of the flow diverter and may be arranged symmetrically, e.g. such that a balanced reaction force acts on the flow diverter, which may reduce fatigue thereof.

At least one or each of the activation paths may comprise an activation inlet and an activation outlet. The activation inlet may be placed eccentrically within the flow diverter. The activation inlet may have a diameter smaller than a diameter of the diversion inlet.

The activation path may be or comprise a channel, which may be a straight channel, extending from the activation inlet to the activation outlet. The activation path may run parallel to part of the diversion path. The activation path may comprise a plurality of, e.g. three, circumferentially spaced channels, each having an activation inlet and activation outlet, which may enable a substantially high flow rate to pass through the flow diverter without causing damage thereto.

The flow diverter may be reconfigurable from a configuration in which flow is routed or predominantly routed through the at least one diversion path into a configuration in which flow is routed or predominantly routed through the at least one activation path, e.g. under the action of a first activator. The first activator may be received by the flow diverter in order to deliver the first pressure signal to the first perforating gun. The first activator may be a first ball or dart. The first activator may be configured to land near or on the diversion inlet of the diversion path, such that flow may be prevented from entering the diversion path. This may cause an increase in pressure in the activation path. This increase in pressure may function to deliver the first pressure signal to the first perforating gun.

The first activator may be specifically sized to land on the diversion inlet of the diversion path. In particular, the first activator may be specifically sized to land on the tapered section of the diversion path, e.g. to engage with the diversion inlet and/or tapered section so as to lodge in the diversion inlet and/or tapered section.

In an alternative example, the perforating apparatus may not comprise a flow diverter, but instead may instead comprise an activation path connected to the first perforating gun. In this example, the first pressure signal may be delivered simply by supplying or increasing a pressure signal to the perforating apparatus. That is, an initial pressure (which may be a small, or zero, pressure) may initially be delivered to the perforating apparatus without firing the first perforating gun. To deliver the first pressure signal, the pressure to the apparatus may be increased above a threshold, which may enable the first pressure signal to be delivered to the first perforating gun.

As noted above, in the second configuration, the isolator mechanism may permit the bypass to receive a pressure signal that is conveyed to the second perforation gun by the bypass. The moveable object may comprise a receiving section configured to receive a second activator, e.g. to reconfigure the isolator mechanism into the second configuration. The second activator may comprise a second ball or dart, which may have a different (e.g. larger) diameter than the first activator. The receiving section and second activator, once received, may form a seal so that flow is substantially prevented from entering the passageway of the body of the isolator mechanism.

Once the second activator is received, an increase in pressure may be built up behind the second activator which may function to move the moveable object and thereby reconfigure the isolator mechanism from the first configuration to the second configuration. That is, the isolator mechanism may be configured such that sealing the passageway of the body of the isolator mechanism using the second activator mechanism may cause a pressure differential to increase beyond an associated threshold, which may thereby cause the movable object to move and thereby reconfigure the isolator mechanism from the first configuration into the second configuration. Thus, such an arrangement may enable the isolator mechanism to be selectively and easily reconfigurable to the second configuration.

The moveable object may define an opening configured to permit a pressure signal to pass therethrough. The first activator may be provided with a diameter smaller than a diameter of the opening of the moveable object. The first activator may thus be configured to pass through the opening in order to land on the inlet of the diversion path.

The perforating apparatus may define an outer diameter and/or form which permits suitable downhole deployment and operation. For example, the perforating apparatus may be cylindrical.

An aspect of the present disclosure relates to a method for operating a perforating apparatus, the method comprising:

locating the perforating apparatus in a first position in a structure to be perforated;

providing an isolator mechanism of the perforating apparatus in a first configuration;

wherein in the first configuration, a bypass extending from a first axial side of a first perforating gun to a second perforating gun mounted on a second axial side of the first perforating gun is isolated from receiving a pressure signal to the second perforating gun;

delivering a first pressure signal from the first axial side of the first perforating gun to the first perforating gun, wherein the first perforating gun is configured to fire responsive to receipt of the first pressure signal;

relocating the perforating apparatus to a second position in the structure to be perforated;

reconfiguring the isolator mechanism to a second configuration, in which the bypass is permitted to receive a pressure signal to the second perforating gun; and delivering a second pressure signal from the first axial side of the first perforating gun to the second perforating gun, wherein the second perforating gun is configured to fire responsive to receipt of the second pressure signal.

The perforating apparatus may be or comprise the perforating apparatus of the first aspect.

An aspect of the present disclosure relates to a method for removing a trapped substance from an annulus of a downhole structure, the method comprising:

locating a perforating apparatus in a first position in the structure;

providing an isolator mechanism of the perforating apparatus in a first configuration;

wherein in the first configuration, a bypass, extending from a first axial side of a first perforating gun to a second perforating gun mounted on a second axial side of the first perforating gun, is isolated from receiving a pressure signal to the second perforating gun;

delivering a first pressure signal from the first axial side of the first perforating gun to the first perforating gun, wherein the first perforating gun is configured to create a first perforation in the structure upon receipt of the first pressure signal;

relocating the perforating apparatus to a second position in the structure;

reconfiguring the isolator mechanism to a second configuration, in which the bypass is permitted to receive a pressure signal to the second perforating gun;

delivering a second pressure signal from the first axial side of the first perforating gun to the second perforating gun, wherein the second perforating gun is configured to create a second perforation in the structure upon receipt of the second pressure signal; and injecting a circulation fluid into the first perforation, through the annulus and out of the second perforation such that the trapped substance is removed from the annulus with the circulation fluid.

An aspect of the present disclosure relates to a method of operating a perforating apparatus downhole, the perforating apparatus comprising at least a first perforating gun and a second perforating gun, the method comprising:

locating the perforating apparatus in a first position downhole such that the first perforating gun is uphole of the second perforating gun;

delivering a first pressure signal to the first perforating gun from the uphole side of the first perforating gun, wherein the first perforating gun is operable to perform a perforation operation responsive to the first pressure signal, e.g. to create a first perforation;

after operation of the first perforating gun, relocating the perforating apparatus to a second position in the structure; and delivering a second pressure signal from the uphole side of the first perforating gun to the second perforating gun via a bypass that bypasses the first perforating gun, wherein the second perforating gun is configured to create a second perforation in the structure responsive to receipt of the second pressure signal.

The bypass may extend from the uphole side of a first perforating gun to the second perforating gun, e.g. to the downhole side of the first perforating gun. The second location may be downhole of the first location.

The delivering of the first pressure signal to the first perforating gun may comprise providing an isolator mechanism of the perforating apparatus in a first configuration. In the first configuration, the bypass may be isolated from receiving a pressure signal, e.g. the second pressure signal, to the second perforating gun.

The delivering of the second pressure signal to the second perforating gun may comprise reconfiguring the isolator mechanism to a second configuration, in which the bypass is permitted to receive a pressure signal, e.g. the second pressure signal, to the second perforating gun.

The wellbore may be provided with a well-control system, which may comprise a blow-out preventer (BOP), which may be located on or near the surface. The locating of the perforating apparatus in the first position downhole may comprise locating the first perforating gun downhole of the control apparatus and optionally proximate the well-control system. By configuring the perforating apparatus such that the first perforating gun that is uphole of the second perforation gun is firable before the second perforating gun, then the risk of misfiring of a perforating gun close to the well-control system during near surface operations may be reduced.

The perforating apparatus may be or comprise a perforating apparatus according to any of the above or below aspects. The method may comprise or be comprised in a method according to any of the above methods.

An aspect of the present disclosure relates to a perforating apparatus, comprising:

a first perforating gun configured to fire upon receipt of a first signal delivered from a first axial side of the first perforating gun;

a second perforating gun mounted on a second axial side of the first perforating gun and configured to fire upon receipt of a second signal delivered from the first axial side of the first perforating gun;

a bypass extending from the first axial side of the first perforating gun to the second perforating gun for communicating the second signal to the second perforating gun; and an isolator mechanism configurable between a first configuration in which the bypass is isolated from receiving a signal to the second perforating gun, and a second configuration in which the bypass is permitted to receive a signal.

It should be recognized that the features defined in relation to one aspect may be applied in combination with any other aspect.

BRIEF DESCRIPTION OF THE DRAWINGS

These and other aspects of the present disclosure will now be described, by way of example only, with reference to the accompanying drawings, in which.

DETAILED DESCRIPTION OF THE DRAWINGS

The present disclosure relates to a perforating apparatus which may be utilized for a variety of applications. In the description that follows, example forms of the perforating apparatus are presented, without any intended restriction on a specific application or use, although some examples of potential operations that could be performed using the perforating apparatus will be suggested, and one specific example use of the apparatus will be provided.

Figure 1:
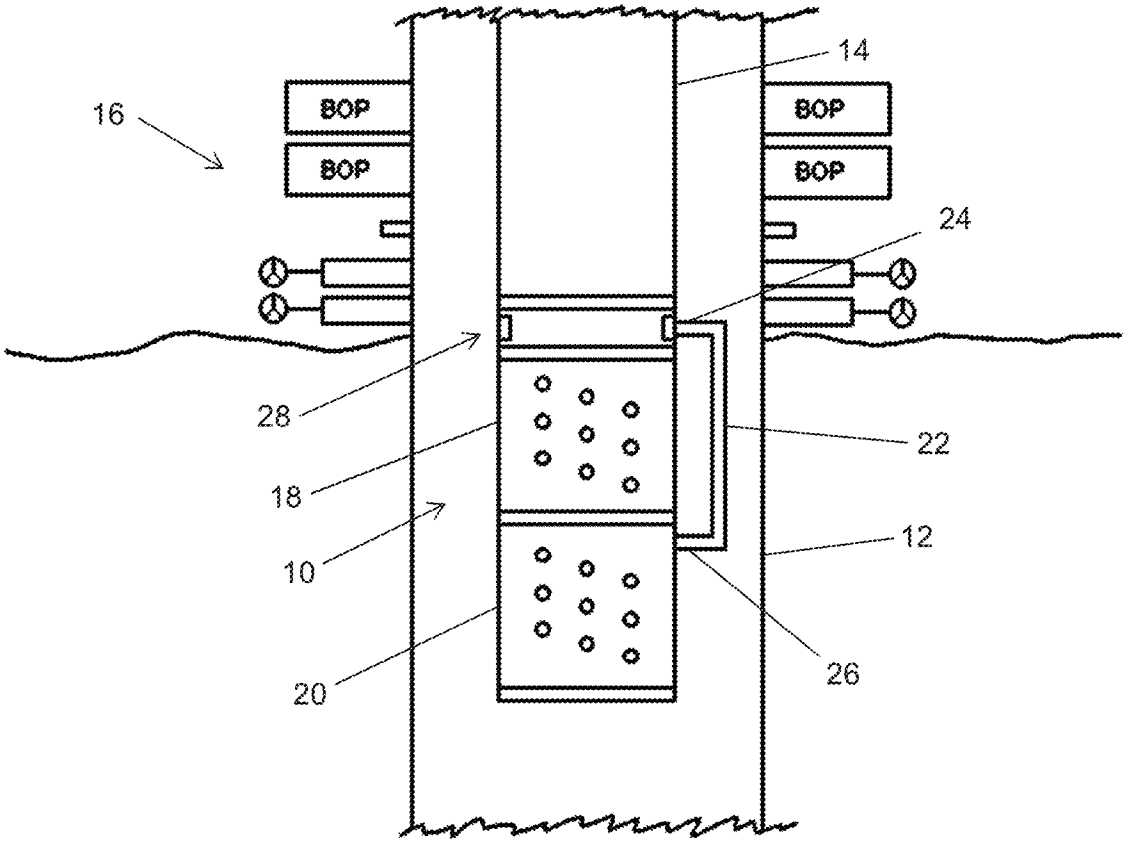
FIG. 1 is a diagrammatic illustration of a perforating apparatus, in use, and located in a wellbore.

A diagrammatic illustration of the perforating apparatus, generally identified by reference numeral 10, deployed in a wellbore 12 is shown in FIG. 1. While the perforating apparatus 10 may be used in a wide range of applications, this example shows the perforating apparatus used in a wellbore application. Therefore, in this case, the perforating apparatus 10 defines an outer diameter and form which permits suitable downhole deployment and operation. For example, the perforating apparatus 10 could be cylindrical, although this is not essential.

As shown, the perforating apparatus 10 is run into the wellbore 12 by a tubing string 14 to which the perforating apparatus 10 is mounted. In this example, a first axial side (e.g. an uphole side in use) of the perforating apparatus 10 is mounted to the tubing string 14. A pressure signal may be communicated to the apparatus 10 from a pump (not shown) or other pressure controlling apparatus, which could for example be located at the surface, via the tubing string 14. As can be seen, the perforating apparatus 10 is positioned in the wellbore 12 at a location close to a wellhead area, which includes a well-control system 16. The perforating apparatus 10 includes a first perforating gun 18 and a second perforating gun 20. The second perforating gun 20 is mounted on a second axial side (e.g. a downhole side in use) of the first perforating gun 18.

The perforating apparatus 10 includes a bypass 22. The bypass 22 is connected at its first end 24 on the first axial (e.g. uphole) side of the first perforating gun 18, and extends from the first axial side of the first perforating gun 18 to the second perforating gun 20, to which the bypass 22 is connected at its second end 26. In this way, the bypass 22 effectively bypasses the first perforating gun 18. This enables a pressure signal to be delivered to the second perforating gun 20 from the first axial side of the first perforating gun 18. As can be seen, the bypass 22 extends externally of the first perforating gun 18. The bypass 22 is located between trajectories of the charges of the first perforating gun 18, as is discussed in more detail below.

Figure 2:
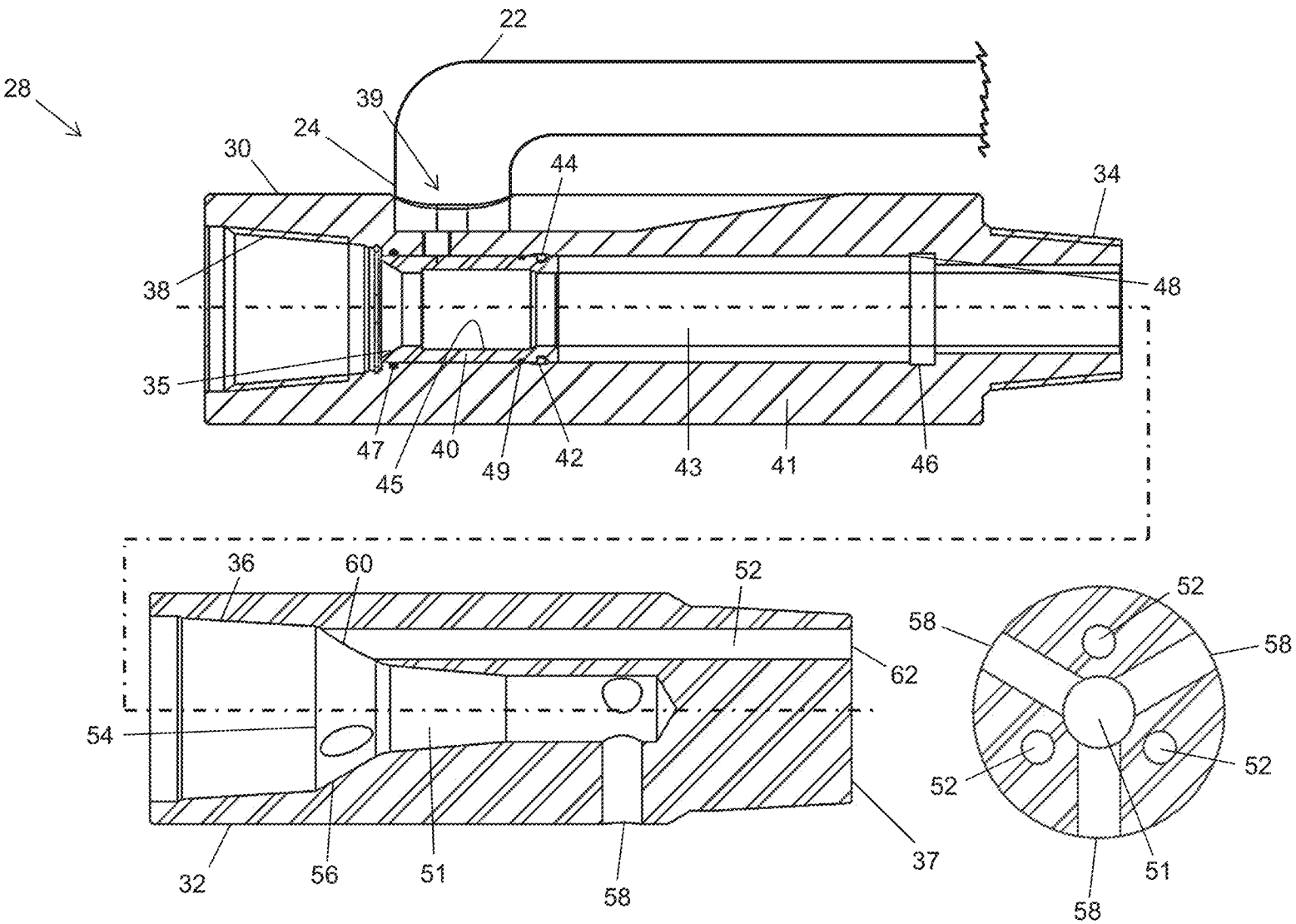
FIG. 2 is a cross-sectional view of an isolator mechanism and a flow diverter of the perforating apparatus, wherein the isolator mechanism is in a first configuration.

The apparatus 10 includes an isolator mechanism and a flow diverter, which are generally indicated together by reference numeral 28. FIG. 2 shows an enlarged cross-sectional view of the isolator mechanism 30 and flow diverter 32. In the shown example, the isolator mechanism 30 is connected to the flow diverter 32 via threaded sections 34 and 36. The isolator mechanism 30 is provided with a further threaded section 38, which, for example, may be used to connect the apparatus 10 to the tubing string 14. The flow diverter 32 is provided with a flat-ended surface 37. The surface 37 may be configured to engage or connect with the first perforating gun 18. While threaded connections have been used in this example, the skilled person will appreciate that alternative connections may be used, such as interference fits, fasteners, etc.

The bypass 22 is connected at its first end 24 to a port 39 located on a side face of the isolator mechanism 30. In this example, the bypass 22 is threadably connected to the port 39. However, alternative connections may be used, such as an interference fit, etc.

The isolator mechanism 30 includes a body 41 defining a passageway 43 configured to permit a pressure signal to pass therethrough. The passageway 43 is located centrally in the isolator mechanism 30.

The isolator mechanism 30 includes a moveable object, which, in this example, is a slideable sleeve 40. The slideable sleeve 40 includes an opening 45 configured to permit a pressure signal to pass therethrough. FIG. 2 shows the isolator mechanism 30 in a first configuration in which the isolator mechanism 30 blocks the port 39 so as to prevent pressure signals received by the isolator mechanism 30, e.g. from the tubing string 14, from being passed to the bypass 22. In this first configuration of the isolator mechanism 30, the slideable sleeve 40 is positioned so as to isolate the bypass 22 from receiving pressure signals from within the isolator mechanism 30 (e.g. from within the opening 45). The isolator mechanism 30 is provided with seals 47 and 49 that are configured to seal between the slidable sleeve 40 and an interior wall of the body 41 that defines the passageway 43 to assist in isolating the bypass 22 from receiving pressure signals when the isolator mechanism 30 is in the first configuration. The slideable sleeve 40 includes a receiving section 35 on an uphole/surface side thereof, the receiving section 35 being configured to receive a second activator, which is discussed in more detail below. In this example, the receiving section 35 is inwardly tapered or otherwise shaped in order to securely receive the second activator. While a slideable sleeve has been shown in this example, the skilled person will appreciate, however, that alternative moveable objects may also be used, such as a gate, etc.

The isolator mechanism 30 further defines a first recess 42 including an oblique surface (not shown). In the first configuration, the slideable sleeve 40 is releasably secured to the first recess 42 by way of a releasable connection therewith. In this example, the releasable connection includes a locking ring 44 configured to releasably connect with the first recess 42, in the first configuration. The locking ring 44 is radially outwardly biased such that it is forced into contact with the first recess 42 when the isolator mechanism 30 is in the first configuration. The skilled person will appreciate, however, that the releasable connection may instead comprise any other suitable means, such as a shear pin, ratchet, spring, adhesive, etc.

The isolator mechanism 30 further defines a second recess 46. The second recess 46 is positioned axially away from the first recess 42 in a direction towards the flow diverter 32. The second recess 46 includes a shoulder 48 configured to engage the locking ring 44, when the isolator mechanism 30 is in the second configuration, such that the slidable sleeve 40 is locked in position relative to the body 41 of the isolator mechanism 30. As such, in the second configuration of the isolator mechanism 30, the slideable sleeve 40 is removed from the port 39 and the bypass 22 is permitted to receive a pressure signal for the second perforating gun 20.

The flow diverter 32 includes a diversion path 51 configured to divert flow away from the first perforating gun 20. The diversion path 51 includes a diversion inlet 54, which is placed centrally within the flow diverter 32. The diversion path 51 includes a tapered section 56, which is tapered inwardly as it extends in a direction generally away from the diversion inlet 54 and towards a diversion outlet. In this example, the diversion outlet includes three circumferentially spaced outlet ports 58, which are located on an external, side face of the flow diverter 32, and are arranged symmetrically so that a balanced reaction force may act on the flow diverter 32. The flow diverter 32 thus enables a pressure signal or other flow to be initially circulated through the apparatus 10, if desired, without the first perforating gun 18 or second perforating gun 20 being fired.

The flow diverter 32 also includes an activation path 52 configured to deliver a pressure signal to the first perforating gun 18. The activation path 52 includes an activation inlet 60 and an activation outlet 62. The activation path 52 is placed eccentrically within the flow diverter 32. Furthermore, the activation inlet 60 has a diameter smaller than a diameter of the diversion inlet 54. Consequently, a higher flow rate may initially pass through the diversion path than the activation path. In this example, the activation path 52 includes three circumferentially spaced channels that each linearly extend from their respective inlets 60 to their respective outlets 62. The activation paths 52 run parallel to at least part of the diversion path 51.

Figure 4:
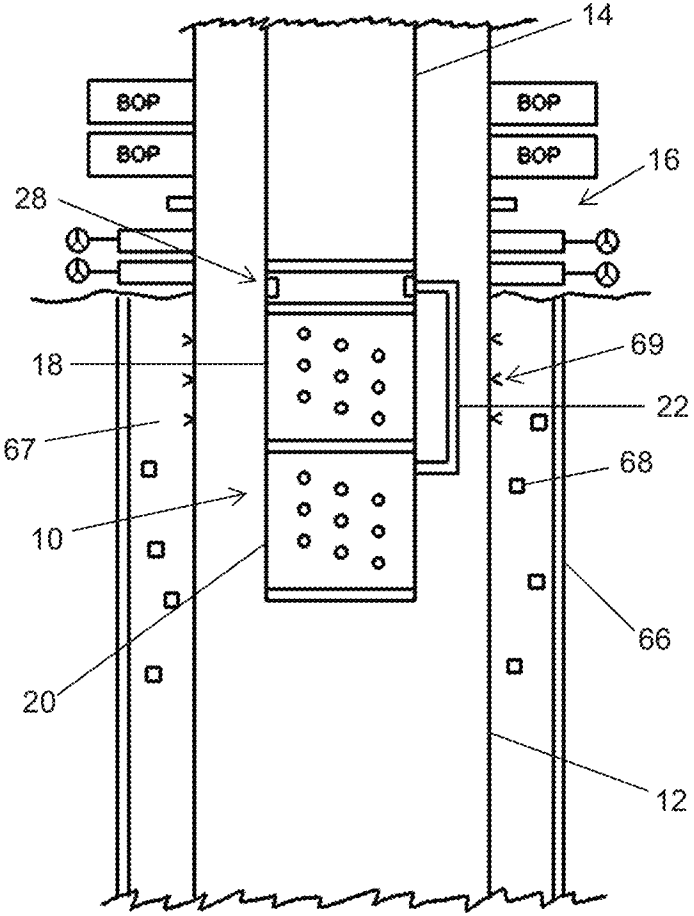
FIG. 4 is a diagrammatic illustration of a first stage of an example application of the perforating apparatus.
Figure 3:
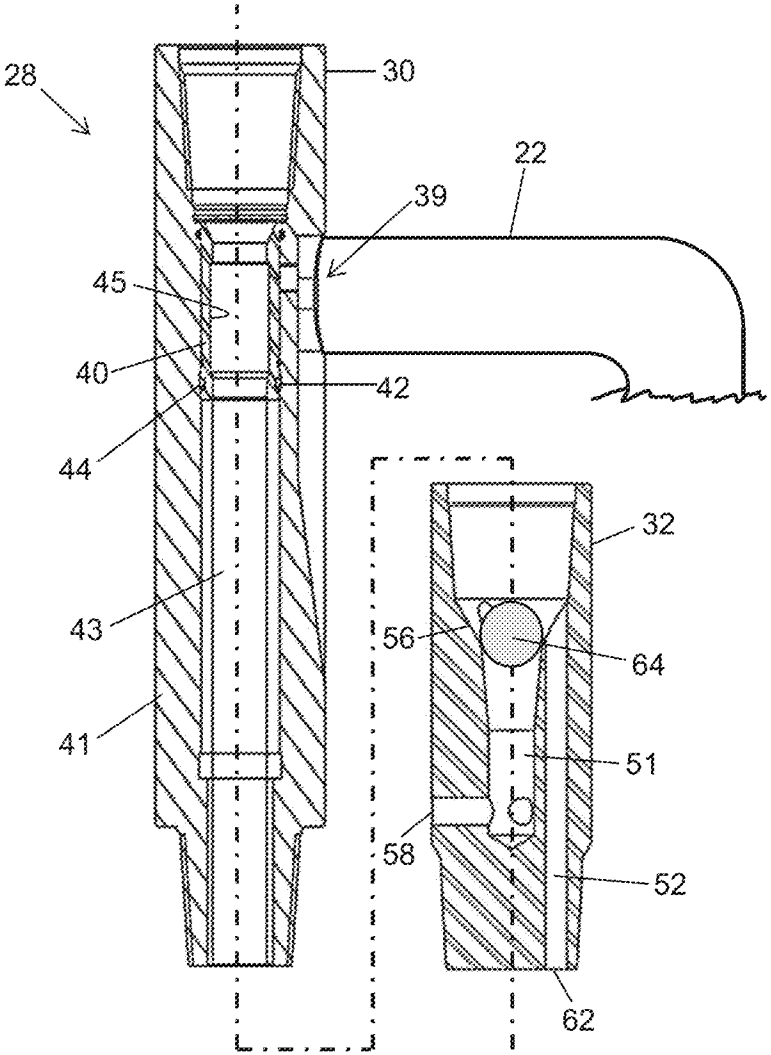
FIG. 3 is a cross-sectional view of the isolator mechanism and the flow diverter with a first activator received by the flow diverter.

FIGS. 3 and 4 depict a first stage of an example application of the perforating apparatus 10. Specifically, the example application relates to a well-decommissioning application involving the recovery of an oil-based mud 68 trapped in an annulus 67 between a casing 66 and the wellbore 12.

Referring specifically to FIG. 3, there is shown a cross-sectional view of the isolator mechanism 30 in its first configuration, as well as the flow diverter 32 with a first activator 64 received by the tapered section 56 of the diversion path 51. In this example, the first activator 64 is a drop ball. However, the skilled person will appreciate that alternative activators may be used, such as a dart, etc.

As can be seen in FIG. 3, the isolator mechanism 30 is in its first configuration with the slideable sleeve 40 isolating the bypass 22 from receiving a pressure signal, for example, from the tubing string 14. As such, the second perforating gun 20 is isolated from receiving a pressure signal.

As noted above, the ball 64 is landed on the tapered section 56 of the flow diverter 32, for example, by dropping the ball 64 from the surface through the tubing string 14 and passageway 43. Thus, with the ball 64 received, flow being communicated from the tubing string 14 is blocked from entering the diversion path 51. As such, flow can no longer exit the apparatus 10 through the outlet ports 58, and consequently hydraulic pressure is increased in the activation path 52. This increase in pressure may function to deliver the first pressure signal to the first perforating gun 18, e.g. by increasing the pressure in the activation path 52 above a pressure threshold.

FIG. 4 shows a diagrammatic illustration of the perforating apparatus 10 in a first position in the wellbore 12. As shown, the first perforating gun 18 has been fired, by way of the above-described procedure, and a first set of perforations 69 has been created in the wellbore 12 positioned just below the well-control system 16.

It is worth noting, with reference to FIG. 4, that if the second perforating gun 20 had to be fired first, the first perforating gun 18 would be axially aligned with the well-control system 16 at the time of firing the second gun 20. As previously discussed, such an operation would have the potential to pose a risk to the well-control system. As such, being able to fire the first perforating gun 18 (i.e. an uphole perforating gun) before firing the second perforating gun (i.e. a downhole perforating gun) may be particularly beneficial in such "near surface" operations.

Figure 6:
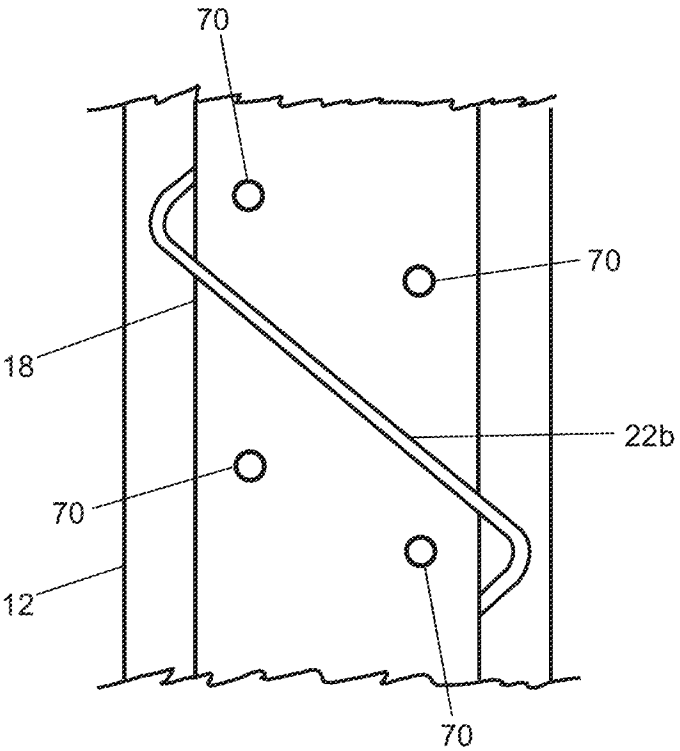
FIG. 6 is a diagrammatic illustration of the scallop or shot profile of the first perforating gun with an alternative bypass helically extending around the first perforating gun.
Figure 5:
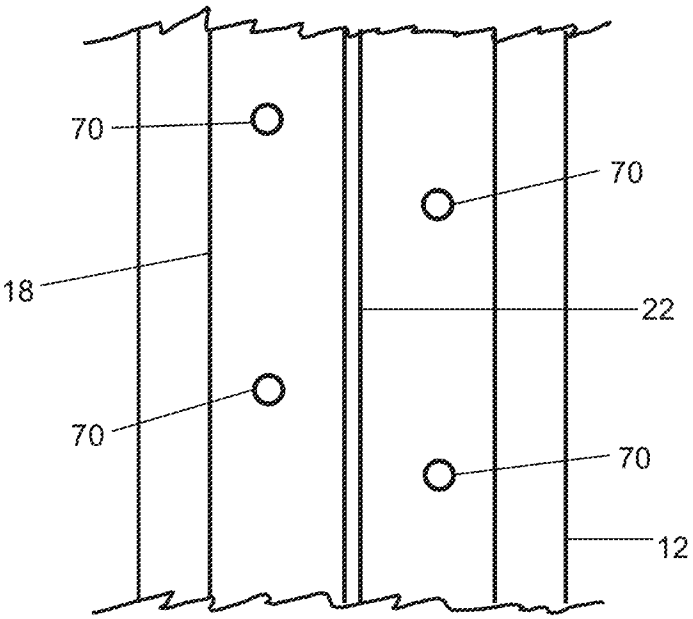
FIG. 5 is a diagrammatic illustration of a scallop or shot profile of the first perforating gun with a bypass linearly extending from a first axial side of the first perforating gun to the second perforating gun.

Referring now to FIGS. 5 and 6, there is shown a scallop or shot profile of the first perforating gun 18, which is defined by a plurality of scallops or shots 70. As can be seen, the bypass 22 extends through a non-firing zone of the shot profile. The non-firing zone may be identified as an area of the scallop or shot profile in which no charges or shots 70 are fired. FIG. 5 shows an example bypass 22 which extends linearly across the first perforating gun 18, between charges or shots 70 of the first perforating gun 18, towards the second perforating gun 20. FIG. 6 shows an alternative bypass 22*b* which extends helically around the first perforating gun 18 and between charges or shots 70 of the first perforating gun 18, which are also arranged in a generally helical distribution.

Figure 8:
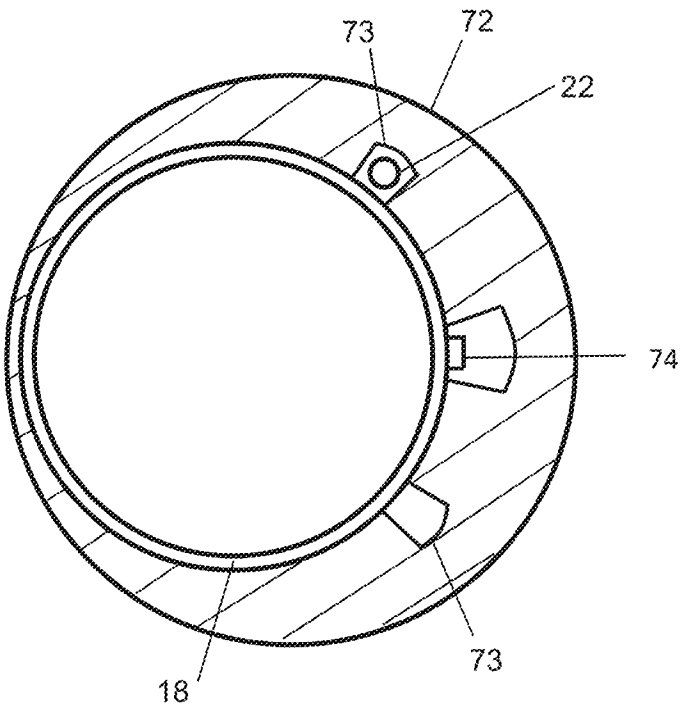
FIG. 8 is cross-sectional view of the clamp of FIG. 7 taken along line X-X.
Figure 7:
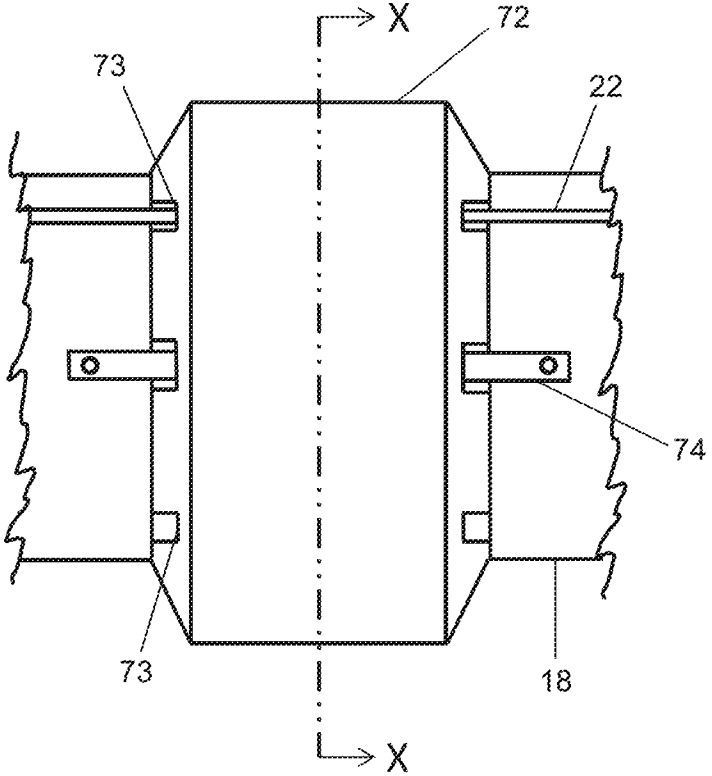
FIG. 7 is a diagrammatic illustration of an example clamp supporting the bypass.

FIG. 7 shows a clamp 72 configured to provide structural support to the bypass 22. The clamp 72 is secured by a lock 74 to a section of the first perforating gun 18 in which no scallops or shots are present. The skilled person will appreciate, however, that while a rectangular lock 74 has been shown in FIG. 7, any suitable lock may be used, such as a tapered lock. FIG. 8 shows a cross-sectional view of the clamp 72 taken along dashed line X-X in FIG. 7. The clamp 72 includes an aperture 73 for locating the bypass 22 therein. The clamp 72 may include a plurality of apertures 73 for supporting a plurality of bypasses 22, if desired. As can be seen, the clamp 72 is eccentrically mounted on the first perforating gun 18, such that the clamp is provided with a larger radial thickness at the side of the clamp 72 including the apertures 73 and lock 74.

Figure 10:
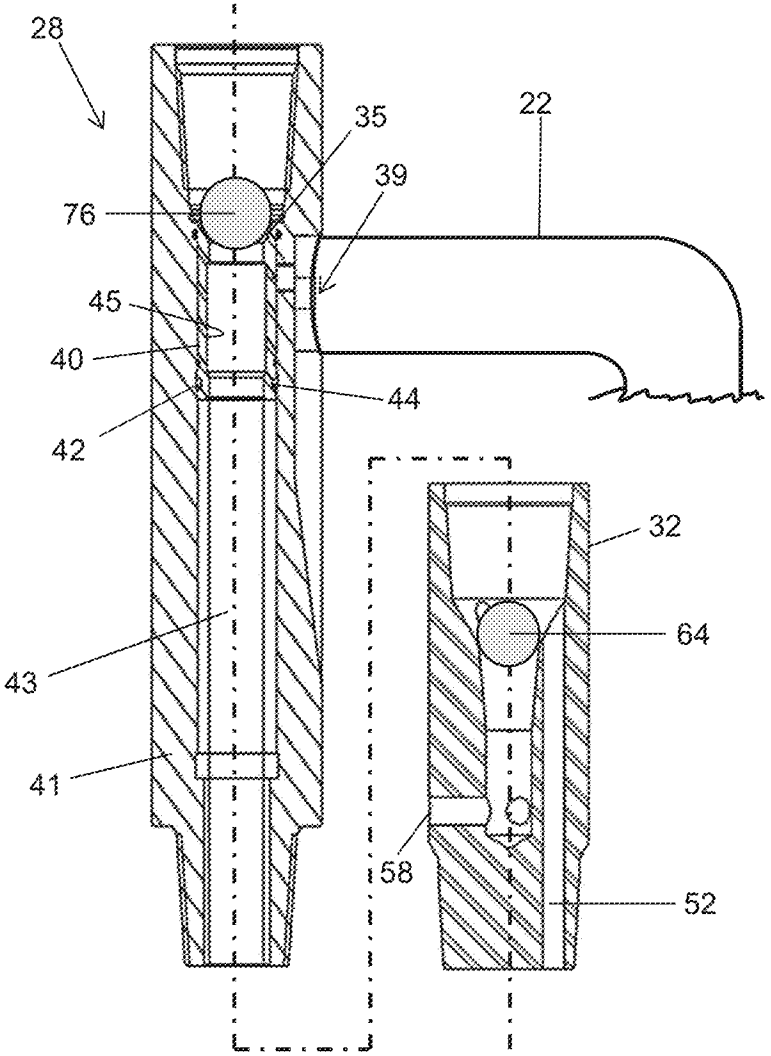
FIG. 10 is a cross-sectional view of the isolator mechanism and the flow diverter with a second activator received by the isolator mechanism, wherein the isolator mechanism is in the first configuration.
Figure 9:
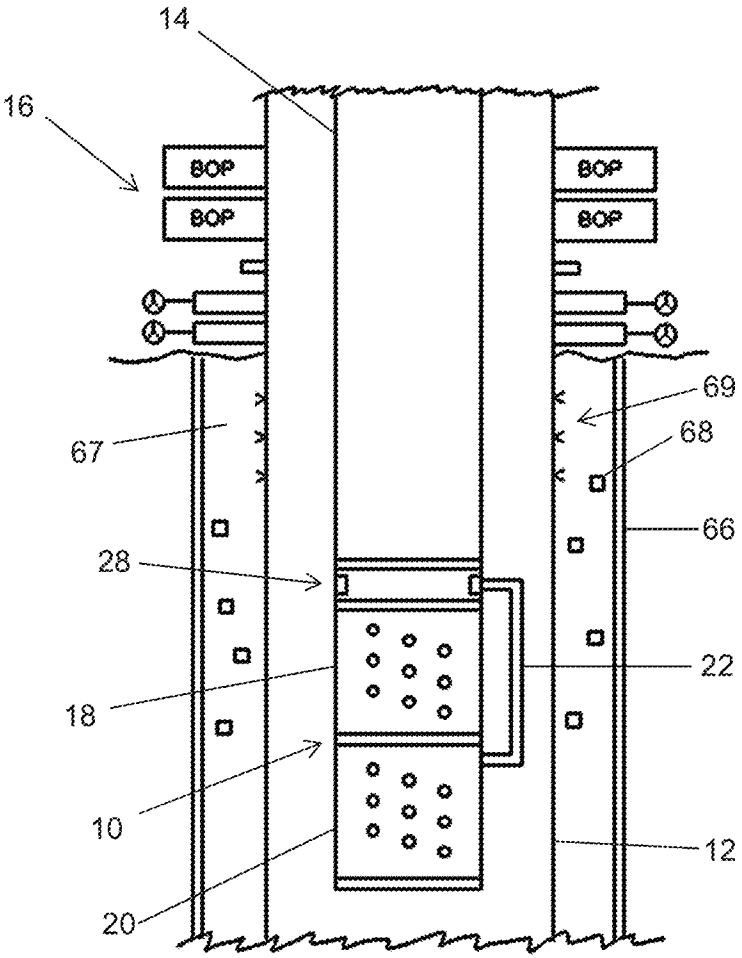
FIG. 9 is a diagrammatic illustration of a second stage of the example application of the perforating apparatus.

FIGS. 9 and 10 depict a second stage of the example application of the perforating apparatus 10. Specifically, FIG. 9 shows a diagrammatic illustration of the perforating apparatus 10 moved to a second position in the wellbore 12. FIG. 10 shows a second activator 76 received by the receiving section 35 of the slideable sleeve 40. In this example, the second activator 76 is a drop ball. However, the skilled person will appreciate that alternative activators may be used, such as a dart, etc.

When the receiving section 35 of the slideable sleeve 40 has received the second activator 76, a substantial seal is formed therebetween, thus flow being communicated from the tubing string 14 can no longer enter the passageway 43 of the isolator mechanism 30. Instead, pressure is built up behind the second activator 76 causing a pressure differential between the interior of the tubing string 14 and the passageway 43 of the isolator mechanism 30, resulting in a force acting on the slideable sleeve 40. Once a predetermined force is reached, the locking ring 44 is configured to disengage the first recess 42. This may be achieved, for example, by selecting a material and thickness of the locking ring 44 that is configured to sufficiently deform at the predetermined force so that the locking ring 44 is able to slide across the oblique surface of the first recess 42 and release the releasable connection.

Figure 11:
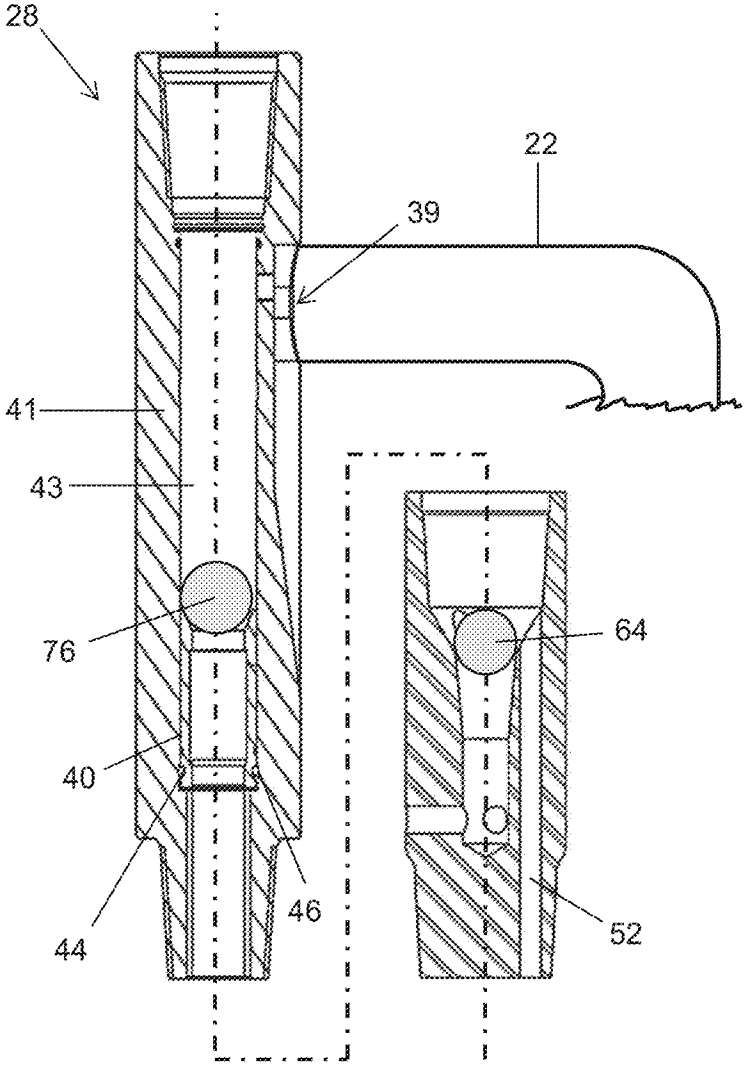
FIG. 11 is a cross-sectional view of the isolator mechanism and the flow diverter with the second activator received by the isolator mechanism, wherein the isolator mechanism is in the second configuration.

Referring now to FIG. 11, there is shown a third stage of the example application of the perforating apparatus 10. The isolator mechanism 32 is shown in its second configuration and as such the slideable sleeve 40 has moved through the passageway 43 towards the second recess 46, and thus away from the port 39. Consequently, the bypass 22 is permitted to receive a pressure signal through the port 39. Thus, as the slideable sleeve 40 slides towards the second recess 46, the second perforating gun 20 is permitted to receive the second pressure signal.

To prevent the isolator mechanism 30 transitioning back to the first configuration, and thus the slideable sleeve 40 sliding back towards the first recess 42, the second recess 46 is provided with a right-angled surface, or shoulder. As the slideable sleeve 40 reaches the position shown in FIG. 11, the locking ring 44 radially expands into the second recess 46 by virtue of its radially outwardly bias. As a result, the second recess 46 engages the locking ring 44 and thereby locks it in place. In this respect, the locking ring 44 and the second recess 46 together may be defined as a locking mechanism. While a locking ring has been shown in this example, the skilled person will appreciate that alternative locking mechanisms may also be used, such as a swellable material, ratchet, adhesive, etc.

Figure 12:
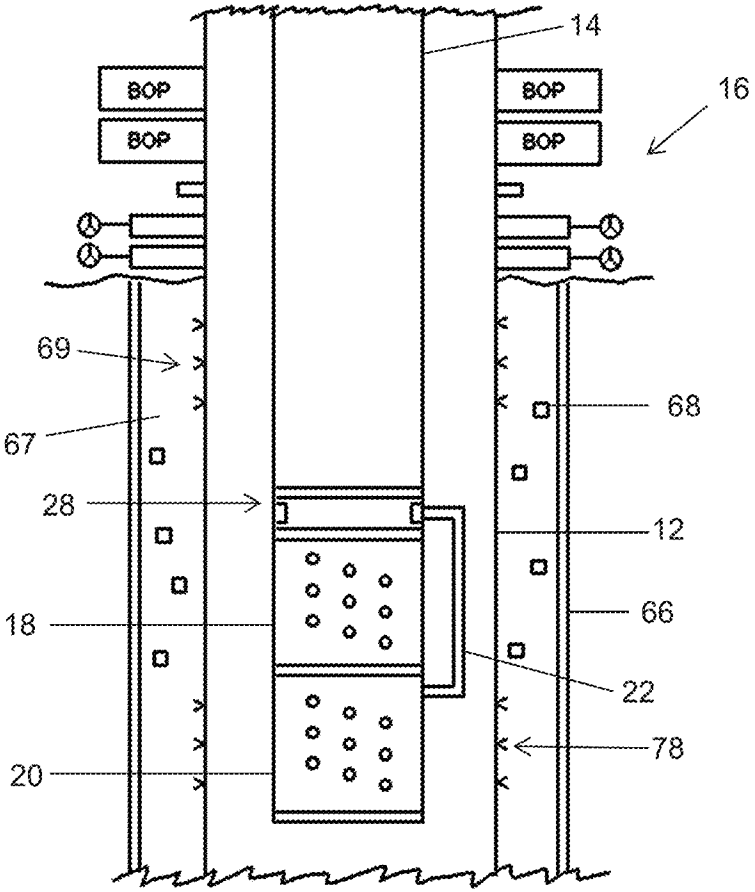
FIG. 12 is a diagrammatic illustration of a third stage of the example application of the perforating apparatus.

FIG. 12 depicts a third stage of the example application of the perforating apparatus 10. As can be seen, the second perforating gun 20 has been fired, by way of the above-described procedure, and a second set of perforations 78 has been created in the wellbore 12, positioned below the first set of perforations 69.

Figure 13:
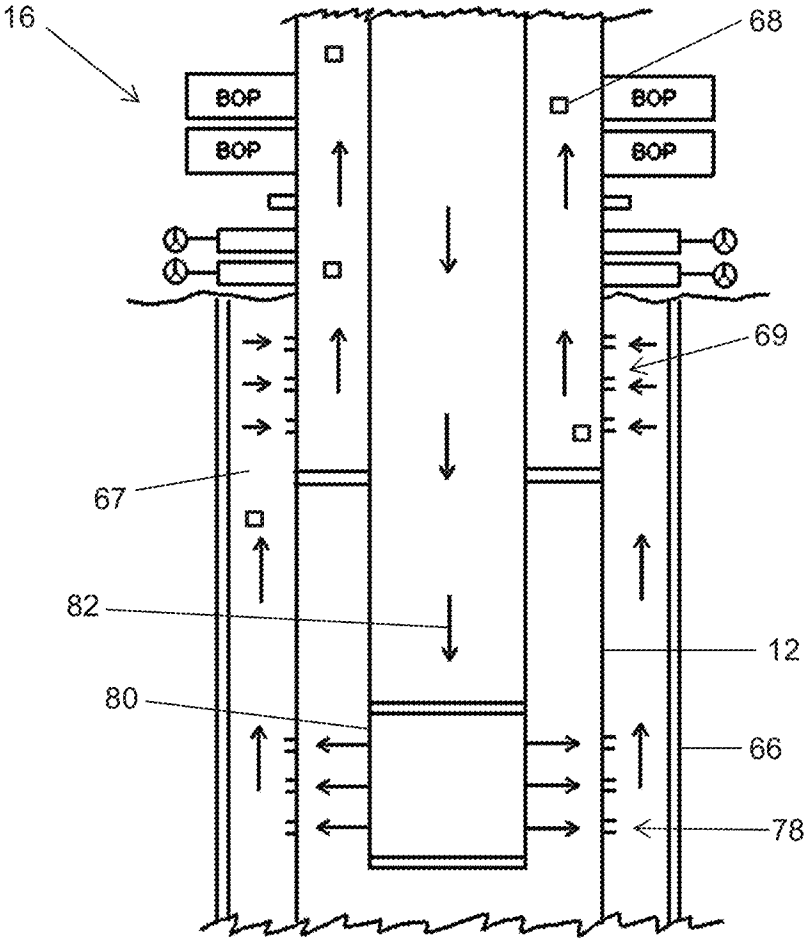
FIG. 13 is a diagrammatic illustration of a fourth stage of the example application of the perforating apparatus.

FIG. 13 depicts a fourth and final stage of the example application of the perforating apparatus 10. In this example, the perforating apparatus 10 has been removed from the wellbore 12 and a suitable injection tool 80 has been run into the wellbore 12. However, if desired, the perforating apparatus 10 may be provided with an on-board injection tool.

The injection tool 80 is configured to inject a pressurized fluid, which is generally indicated by arrows 82, through the second set of perforations 78, into the annulus 67 and out of the first set of perforations 69. It will be appreciated that packers and the like can be used in order to direct the flow in the desired manner. As can be seen, the oil-based mud 68 is removed from the annulus 67 and transported towards the surface with the pressurized fluid 82.

Figure 15:
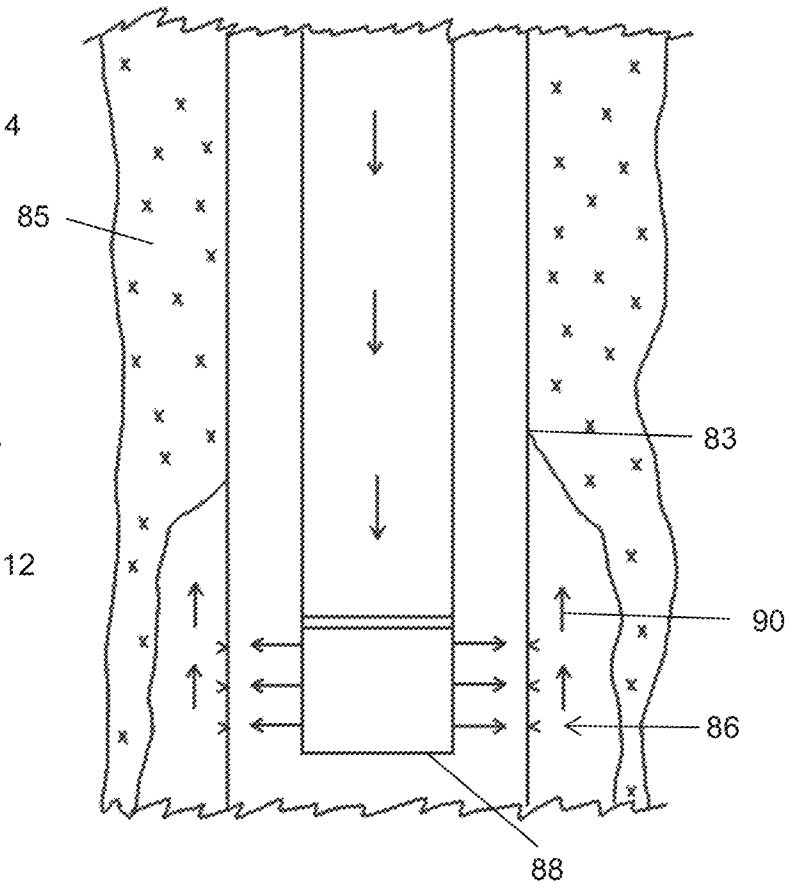
FIG. 15 is a diagrammatic illustration of a second stage of the alternative example application.
Figure 14:
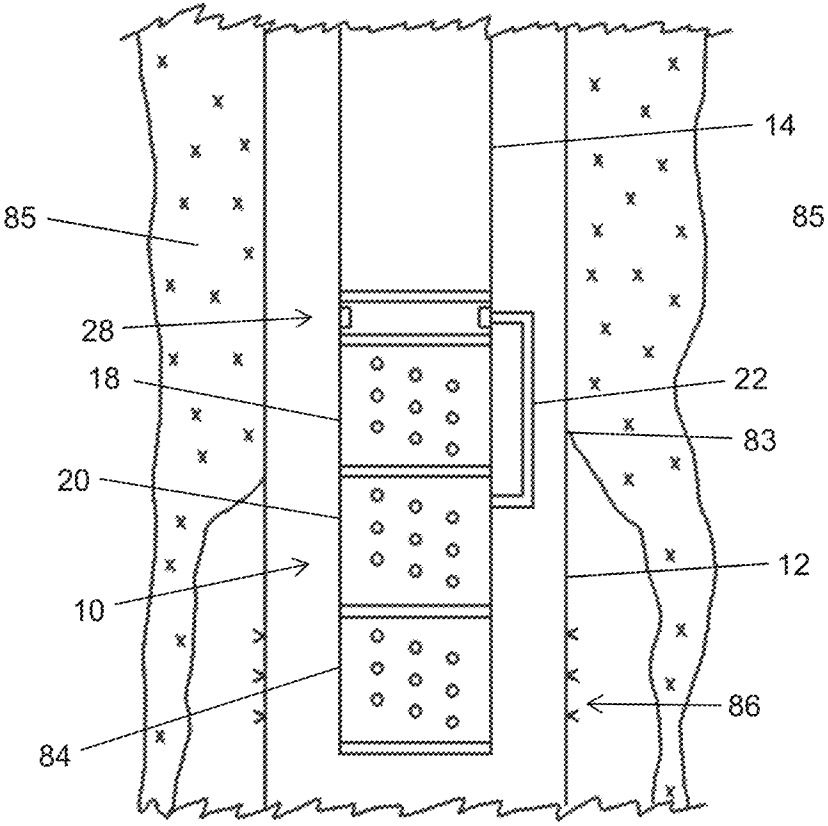
FIG. 14 is a diagrammatic illustration of a first stage of an alternative example application of the perforating apparatus.

Referring now to FIGS. 14 and 15, there is shown an alternative example of the perforating apparatus 10. In this example, the perforating apparatus 10 includes a third perforating gun 84 mounted on a second axial side of the second perforating gun 20. The perforating apparatus 10 has been run deeper into the wellbore 12 by the tubing string 14 to reach a location in which it is desired to pressure test a naturally-formed seal 83. For example, the naturally-formed seal may exist between a rock formation 85 and an external surface of the wellbore 12. The naturally-formed seal 83 may be formed by the creep of the rock formation 85 towards the wellbore 12. For example, the rock formation 85 may comprise sedimentary rock, such as shale rock.

In this alternative example application, the third gun 84 has been fired to create a third set of perforations 86 in the wellbore 12 at a position below the naturally-formed seal 83, such that a pressure signal, generally indicated by arrows 90, may be communicated through the third set of perforations 86 to test the sealing capability of the seal 83. The pressure signal may include hydraulics, acoustics, or any other suitable means.

It should be understood that the examples provided herein are merely exemplary of the present disclosure and that various modifications may be made thereto without departing from the scope defined by the claims.

The invention claimed is:

1. A perforating apparatus, comprising:

a first perforating gun configured to fire upon receipt of a first pressure signal delivered from a first axial side of the first perforating gun;

a second perforating gun mounted on a second axial side of the first perforating gun and configured to fire upon receipt of a second pressure signal delivered from the first axial side of the first perforating gun;

a bypass extending from the first axial side of the first perforating gun to the second perforating gun for communicating the second pressure signal to the second perforating gun;

an isolator mechanism configurable between a first configuration in which the bypass is isolated from receiving a pressure signal to the second perforating gun, and a second configuration in which the bypass is permitted to receive a pressure signal; wherein the isolator mechanism is reconfigurable from the first configuration to the second configuration after the first perforating gun has been fired; and a flow diverter comprising a diversion path and an activation path, the flow diverter configured to selectively route the first pressure signal to the activation path under the action of a first activator to fire the first perforating gun.

2. The perforating apparatus according to claim 1, wherein the bypass extends from the first axial side of the first perforating gun to the second perforating gun externally of the first perforating gun.

3. The perforating apparatus according to claim 1, wherein the bypass extends through a non-firing zone defined by a charge or shot profile of the first perforating gun.

4. The perforating apparatus according to claim 3, wherein the bypass linearly or helically extends through the non-firing zone.

5. The perforating apparatus according to claim 3, wherein the charge or shot profile comprises a maximum number of eighteen charges or shots per foot.

6. The perforating apparatus according to claim 1, wherein the isolator mechanism comprises a moveable object that is movable in order to switch the isolator mechanism from the first configuration to the second configuration after the first perforating gun has been fired.

7. The perforating apparatus according to claim 6, wherein the moveable object comprises a receiving section configured to receive a reconfiguration activator, such that, when received, a second activator is configured to move the moveable object from the first configuration to the second configuration.

8. The perforating apparatus according to claim 7, wherein the first activator comprises a first ball or dart and the reconfiguration activator comprises a second ball or dart and a diameter of the first ball or dart is smaller than a diameter of the second ball or dart.

9. The perforating apparatus according to claim 6, wherein:

the bypass is connected to a port of the isolator mechanism; and in the first configuration, the moveable object isolates the port from receiving a pressure signal to the bypass.

10. The perforating apparatus according to claim 1, wherein the isolator mechanism comprises a releasable connection configured to releasably secure the isolator mechanism in the first configuration.

11. The perforating apparatus according to claim 10, wherein the releasable connection is configured to be released when acted on by a pressure differential and/or force that is above a threshold so that the isolator mechanism transitions from the first configuration to the second configuration.

12. The perforating apparatus according to claim 1, wherein the isolator mechanism comprises a locking mechanism configured to lock the isolator mechanism in the second configuration.

13. The perforating apparatus according to claim 1, wherein the flow diverter is mounted on the first axial side of the first perforating gun.

14. The apparatus according to claim 1, wherein the bypass is supported by a clamp connected to the first perforating gun.

15. The perforating apparatus according to claim 1, further comprising a third perforating gun.

16. The perforating apparatus according to claim 15, wherein the second perforating gun is provided between the first perforating gun and the third perforating gun.

17. A method for operating a perforating apparatus, comprising:

locating the perforating apparatus in a first position in a structure to be perforated;

providing an isolator mechanism of the perforating apparatus in a first configuration; wherein in the first configuration, a bypass, extending from a first axial side of a first perforating gun to a second perforating gun mounted on a second axial side of the first perforating gun, is isolated from receiving a pressure signal to the second perforating gun;

receiving a first activator in a flow diverter of the perforating apparatus, the flow diverter comprising a diversion path and an activation path;

delivering a first pressure signal from the first axial side of the first perforating gun to the first perforating gun, wherein the first perforating gun is configured to fire upon receipt of the first pressure signal, and wherein the first pressure signal is selectively routed to the activation path of the flow diverter under the action of the first activator;

relocating the perforating apparatus to a second position in the structure;

reconfiguring the isolator mechanism to a second configuration, in which the bypass is permitted to receive a pressure signal to the second perforating gun; and delivering a second pressure signal from the first axial side of the first perforating gun to the second perforating gun, wherein the second perforating gun is configured to fire upon receipt of the second pressure signal.

18. The method according to claim 17, wherein the first perforating gun creates a first perforation in the structure and the second perforating gun creates a second perforation in the structure, the method further comprising injecting a circulation fluid into the first perforation and out of the second perforation.

19. A method of operating a perforating apparatus downhole, the perforating apparatus comprising at least a first perforating gun and a second perforating gun, the method comprising:

locating the perforating apparatus in a first position downhole such that the first perforating gun is uphole of the second perforating gun;

receiving a first activator in a flow diverter of the perforating apparatus, the flow diverter comprising a diversion path and an activation path;

delivering a first pressure signal to the first perforating gun from the uphole side of the first perforating gun, wherein the first pressure signal is selectively routed to the activation path of the flow diverter under the action of the first activator, and wherein the first perforating gun is operable to perform a perforation operation responsive to the first pressure signal, to create a first perforation;

after operation of the first perforating gun, relocating the perforating apparatus to a second position in the structure; and delivering a second pressure signal from the uphole side of the first perforating gun to the second perforating gun via a bypass that bypasses the first perforating gun, wherein the second perforating gun is configured to create a second perforation in the structure upon receipt of the second pressure signal.

* * * * *